US006186200B1

(12) United States Patent
Figovsky et al.

(10) Patent No.: US 6,186,200 B1
(45) Date of Patent: Feb. 13, 2001

(54) COMPOSITE WOODEN ARTICLES AND A METHOD OF THEIR MANUFACTURING

(75) Inventors: Oleg Figovsky; Vladimir Teper, both of Haifa (IL)

(73) Assignee: Polymate Ltd., Migdal-Haemek (IL)

( * ) Notice: Under 35 U.S.C. 154(b), the term of this patent shall be extended for 0 days.

(21) Appl. No.: 09/201,103

(22) Filed: Nov. 30, 1998

(51) Int. Cl.[7] ..... B27D 1/00

(52) U.S. Cl. ..... 144/352; 34/143; 100/38; 144/329; 144/359; 144/364; 144/380; 144/350; 427/393; 428/18; 428/106; 428/511

(58) Field of Search ..... 34/143, 145, 396, 34/398, 611; 29/412, 417; 100/38; 144/345, 350, 352, 329, 359, 364, 380; 427/297, 317, 325, 393; 428/18, 105, 106, 511, 537.1

(56) References Cited

U.S. PATENT DOCUMENTS 3,905,172 * 9/1975 Blackburn .
5,067,536 * 11/1991 Liska et al. ..... 144/352
5,279,691 * 1/1994 Stickland ..... 144/352

FOREIGN PATENT DOCUMENTS

1642957 * 10/1990 (RU) .
1761908 * 3/1992 (RU) .

* cited by examiner

*Primary Examiner*—W. Donald Bray
(74) *Attorney, Agent, or Firm*—Blank, Rome, Comisky & McCauley LLP

(57) ABSTRACT

A method of manufacturing tiles from waste wood uses round crosscut wood slices, a binder, and a filler. The slices, all generally of a thickness, are placed on the flat bottom of a die within side walls. Adhesive is applied to the slices and the die is filled with a mixture of the binder and the filler. The die contents are hot pressed to achieve the required tile thickness. The tile is ejected from the die and then maintained at room temperature for not more than 72 hours. The face side of the tile is ground and the dimensions of the tile are brought within the required tolerances.

11 Claims, 3 Drawing Sheets

COMPOSITE WOODEN ARTICLES AND A METHOD OF THEIR MANUFACTURING

FIELD OF THE INVENTION

The present invention relates to the technology of manufacturing of composite wooden tiles, e.g. splint slabs, aslant sawed panel blocks, plank panels etc. These articles are usually made of a wood off-cut component shaped together with a laminating component and a binder in the form of a flat board. Such articles are used mainly for decorative purposes, for example as a parquet, decorative wall panels, furniture panels and so on.

More particularly the present invention refers to manufacturing of such articles by a process of utilizing the wood off-cut component, reducing the consumption of the binder and the laminating component and improving the decorative quality of the final product. By virtue of more efficient consumption of the off-cut component and reduced, consumption of the binder component the process of manufacturing in accordance with the present invention has improved ecological cleanliness.

BACKGROUND OF THE INVENTION

Wood has always been and still remains the preferable construction material that provides for ecological cleanliness and comfort of the premises. However, wood has became less available at mass civil engineering because of its high cost that still does not allow to manage without the use of splint slabs, wooden fiber plywood and other products made with the use of binders based on formaldehyde containing resins. It is therefore desired to recycle the major part of the wood which is inevitably lost during the wood processing.

As it is known, the wood mechanical properties possess anisotropy, i.e. such wood properties like strength, wear resistance, elasticity etc. are dissimilar along and across the fibers. Moreover, the decorative features of the wood structure along the transversal and longitudinal cuts (wood crosscut and wood rip-cut respectively) are also substantially different. These structure differences are associated with the fact that psychologically the human perception of a perfect object is based on its subconscious examination and comparison with the stereotype. From this stand point a surface unit of a wood cross-cut is esthetically advantageous since it is more attractive than that of a rip-cut and this fact enables using of small elements derived from the crosscut wood sections for creating a variety of decorative compositions which impart the final product attractive and natural appearance.

The above provides a basis for the novel approach to the issue of utilizing of wood off-cut wastes which is implemented by the present invention, i.e. utilizing of small off-cut units in the form of slices having certain diameter and height.

In accordance with the invention it is suggested to use such slices to form a face side of a composite wooden tile e.g. a splint-slab or decorative panel. Utilization of off-cut slices facilitates manufacturing of wooden tiles and allows producing of tiles with cery attractive decorative appearance.

The slices are prepared by sawing of the wood off-cuts (knots, substandard saw cuts etc.) to small slice units with equal heights. The slice units are assembled into a pattern to form a face layer of the article. For preparation of slices one can use not only commercial wood off-cuts but also fruit and decorative trees off-cuts. The use of wooden wastes resulting from the processing of various kinds of trees having different colors spectra and variety of the structure of their cross-section enables wide range of decorative combinations especially suitable for design of decorative wooden tiles.

The idea of using the structure of wooden cross-cuts for formation of the face side of a wooden tile has been conceived long time ago. The most explicit example of the use of wood cross-cuts (taking into account that wear resistance of the wood cross-cut is also better that that of the rip-cut) was the use of vertically fit logs in pavements in ancient Russian cities.

In the last decades the wood working industry has shown interest to the use of wood crosscut elements. In German patent DE2355925 there is disclosed the using of rectangular cross-cuts as a basis for the parquet floors. In Russian patent SU 1642957 it is disclosed the use of wooden slices to prepare a basis assembled from splint-slabs or other wood materials. The wooden inserts with equal diameter were glued to the slab's basis to form its face side. The assembled slab was polished and coated with a lacquer. The ready tiles having 500×500 mm size were used as parquet and as decorative panels. The disadvantage of this method is associated with the necessity in time consuming manual gluing of slices.

In Russian patent SU1761908 is disclosed a method of manufacturing of splint slabs in which the wood slices are laid to fit close to each other and the gaps between them is filled with a binder made of a resin based either on oligomers or polymers. The shortcoming of this method is associated with the fact that the bending strength of the ready article is strongly dependent on the binder strength. Furthermore, since the slabs are prepared from dissimilar materials the surface roughness of the ready slabs after polishing becomes heterogeneous and this deteriorates the esthetic appearance of the ready tile.

In Russian patent application 504901/15 of 1992 it is suggested to manufacture wooden boards assembled from butt end slices having two different diameters and of dedicated inserts which should be suitable for filling the free space between the adjacent slices. This method is time and labor consuming since it requires preparation of dedicated inserts, enlarging the space between the adjacent slices and manual placement of the inserts between the slices. Since this method employs only slices with particular diameter the utilization of wooden cross-cuts is limited. Furthermore, esthetically the articles prepared by this method are less attractive since the inserts situated between the large cross-cut slices deteriorate the contiguity of their natural pattern.

Therefore it can be seen that despite the existence of various methods for manufacturing of composite wooden tiles from wood off-cut slices there is still felt a need for a new and improved manufacturing method which will sufficiently reduce or overcome the shortcomings of the prior art methods.

SUMMARY OF THE INVENTION

The main object of the present invention is to provide a new method of manufacturing of decorative wooden composite tiles from wood cross-cut slices which improves utilization of crosscut wastes and thus improves the recycling of wooden wastes associated with the wood processing technology.

The further object of the invention is to provide a new and simple manufacturing method enabling producing of wooden tiles from wooden slices without the necessity of manual filling the intervals between adjacent slices.

Still further object of the invention is to provide a new manufacturing method enabling to reduce the consumption of the laminating component and the binder component in the ready article.

The other object of the invention is to provide a new manufacturing method associated with reduced pollution of the environment due to reduced content of the binder component.

Another object of the invention is to provide a new wooden composite tile having improved decorative quality.

In accordance with the invention the above objects and advantages can be achieved by virtue of the following combination of its essential features referring to different groups of its embodiments.

The first group of embodiments refers to a method of manufacturing of a wooden composite tile from a wooden off-cut component, a binder component and a filler component, the said method comprising the following steps:

a) providing a wood off-cut component in the form of plurality of crosscut slices, said slices being pre-cut from the wastes of wood processing industry, said slices having substantially circled shape defined by a height h and by a first and a second parallel opposite surfaces, b) placing said slices within a die, said die having its flat bottom surrounded by the side walls, the configuration of the die mating the configuration of the ready tile, said slices being arranged on the bottom of the die so as their first surfaces face the flat bottom and define the face side of the ready tile and their opposite second surfaces protrude from the bottom, c) applying an adhesive to the second surfaces of said slices, d) filling the die by a mixture of the binder component with the filler component, e) hot pressing the content of the die so as to achieve the required thickness H of the ready tile, wherein the time T required therefor is defined by the relationship T=0.5 kH, where T is the pressing time in min, k is an empirical coefficient taking into consideration the height h of the slices and their thermal conductivity and H is required thickness of the ready tile in mm, f) ejecting the ready tile from the die, g) maintaining the ready tile at room temperature for not more than 72 hours, h) grinding the face side of the ready tile and bringing its overall dimensions to the required tolerances.

In accordance with one of the embodiments said cross-cut slices are pre-cut from the wood wastes having substantially rectilinear shape with the length 0.3–1.5 m and diameter 40–150 mm.

As per other embodiment said slices are pre-cut so as to have their height h not less than 0.5H, where H is the required thickness of the ready tile and said slices are selected so as to have their respective maximum, intermediate and minimum diameters $D_1$, $D_2$ and $D_3$ defined by the following relationships $D_2$=0.4 $D_1$ and $D_3$=0.1 $D_1$.

In the alternative embodiment said pre-cut slices are dried before they are placed in the die.

According to the further embodiment said adhesive is identical with the binder component.

As per further embodiment after the applying the adhesive the slices are maintained at room temperature for at least 20 minutes before the filling of the die with the mixture of the binder component and the filler component.

In yet another embodiment said slices are pre-cut up to thickness h=8 mm.

According to the other embodiment said ready tile is a decorative panel with the thickness H=18 mm and the hot pressing is effective by applying of pressure of at least 1.5 MPa and temperature of 150–200° C.

In accordance with the further embodiment said ready tile is a decorative furniture board and said slices are arranged across the bottom of the die so as to provide a pattern.

As per another embodiment said slices comprise semicircles and sectors.

As per still another the slices which are configured as sectors are placed in the corners of the die, the slices configured as semicircles are placed along the walls and the slices configured as circles are placed across the reminder of the bottom.

In accordance with the further embodiment said the slices which are configured as circles have substantially similar diameter.

The second group of embodiments refer to the ready tile made of wood wastes.

According to one of the embodiments referring to this group the article is a wooden tile configured as a flat body defined by a face side, a parallel thereto rear side and by lateral walls, the interior of said body comprising a) a wood off-cut component in the form of plurality of crosscut slices, said slices being pre-cut from the wastes of wood processing industry, said slices having substantially circled shape defined by a height h and by a first and a second parallel opposite surfaces, the first surfaces of said slices form the face side of the tile, said slices are selected to have their respective maximum, intermediate and minimum diameters $D_1$, $D_2$ and $D_3$ which are defined by the following relationships $D_2$=0.4–0.5 $D_1$ and $D_3$=0.1–0.5 $D_1$ b) a binder component and c) a filler component, while the filler and the binder components occupy at least part of the empty spaces between the adjacent slices and form the rear side of the ready tile.

As per further embodiment of the tile it is defined by the thickness H, wherein the height h of the slices is at least half of the thickness H.

In yet another the face side of the tile is formed by the slices having dissimilar diameters, wherein at least part of the empty spaces between the adjacent slices is filled by the slices of lesser diameter and by a mixture of the binder component with the filler component.

As per further embodiment said slices form a pattern.

In the further embodiment said tile is a decorative furniture board configured as a rectangular body and said sector shaped slices are located in the corners thereof, the semicircle shaped slices are located along the walls thereof and the circle shaped slices occupy the reminder thereof.

The binder component of the tile can be formaldehyde containing resin and the filler component of the tile can be mixture of saw dust, wooden particles and pieces of thinly sliced wood.

For a better understanding of the present invention as well of its benefits and advantages, reference now will be made to the following description of its various above mentioned embodiments taken in combination with the accompanying drawings.

DETAILED DESCRIPTION OF THE INVENTION

Figure 1:
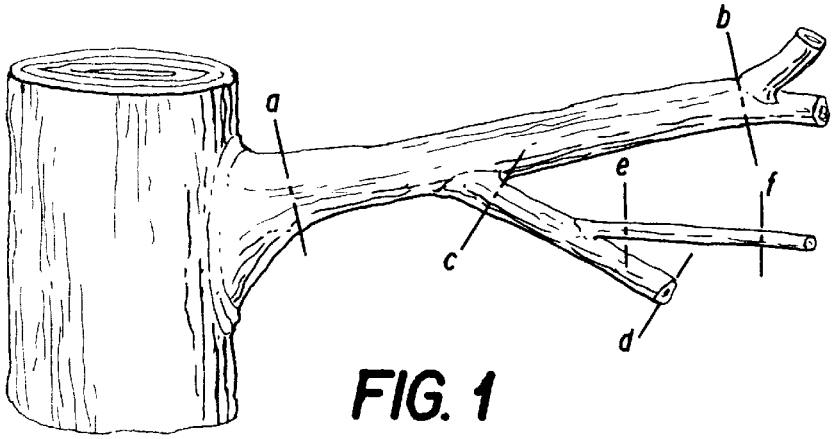
FIG. 1 is a tree branch used as wood cut-off raw material.

With reference to FIG. 1 it is shown an example of a lumber cut-off waste which can be used for implementation the present invention. This raw material is especially suitable for manufacturing of such articles like splint slabs or similar tiles. The face side of these tiles can be formed by wood crosscut elements which are pre-cut from branches, trunks or other lumber wastes of commercial wood of first, second, and sometimes third rate quality, fruit wood, decorative wood, felled trees or from substandard lumbering cutoff wastes.

Figure 2:
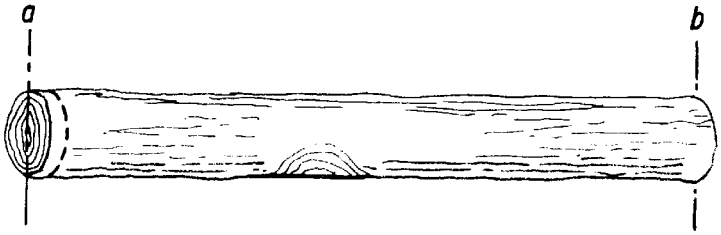
FIG. 2 is a section of the branch suitable for cutting into crosscut slices.
Figure 3A:
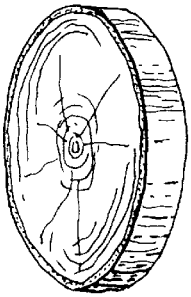
FIGS. 3*a, b, c* present a crosscut wooden slice pre-cut from the rectilinear section shown in FIG. 2.
Figure 3B:
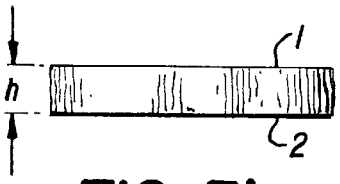
Figure 3C:
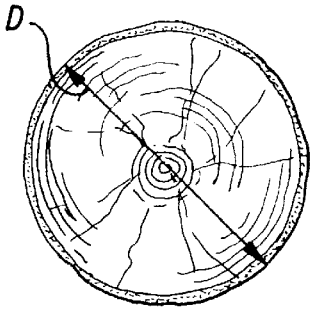
Figure 4A:
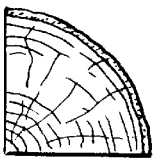
FIG. 4 shows different configurations of crosscut slices pre-cut from the cut-off raw material.
Figure 4B:
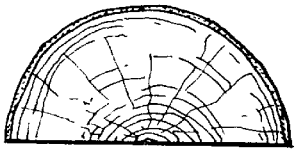
Figure 4C:
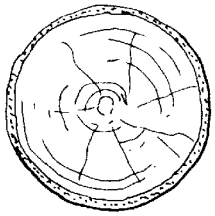
Figure 4D:
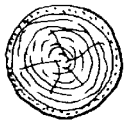
Figure 4E:
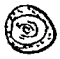
Figure 4F:
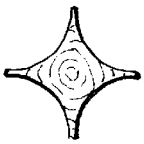
Figure 4S:
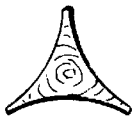

The raw material preparation for forming the face layer of a wooden tile includes the following stages:

- cleaning the selected branch form the branches of higher order and from the crust,
- seeking for relatively rectilinear branches and their sawing along cross-sections a, b, c, d, e, f so as to obtain rectilinear crosscut sections of rectilinear shape as shown in FIG. 2,
- preliminary drying of rectilinear sections in open piles to moisture 22–28%,
- cutting of pre-dried sections into crosscut defined by thickness h, by a first and a second flat opposite surfaces 1, 2 and shaped as shown in FIGS. 3*a, b, c,*
- final drying of pre-cut slices to moisture 8–12%,
- sorting out pre-cut slices;
- preparation of non-circled slices required for manufacturing the tile with patterned face side (if required),
- sorting out of pre-cut slices according to their diameter.

It is advantageous to use rectilinear sections with length of at least 0.3 mm, being preferably 0.3–1.5 m and diameter 40–150 mm for preparation of slices. The thickness h of slices is chosen to satisfy the following equation:

$$h = 0.5H + g + e$$

where:

- H—is the required thickness of the ready article,
- g—is the depth of grinding which is carried out in he end of the manufacturing process,
- e—allowed deflection or waviness of the slice after drying. The allowed waviness should be within 0,9–1,2 mm.

It is advantageous if the final drying of pre-cut slices is carried out in drying chambers in which the slices are arranged in a single row and put on a grid foundation. The distance between the grid rows should be sufficient for obtaining homogeneous flow of hot air over the first and second slice surface in order to prevent warping (distortion). The drying conditions depend on the particular type of the drying chamber and are selected empirically. The main condition for setting up the drying parameters is bringing down the moisture of slices to 8–12% within the shortest possible time and with minimal rejects due to warping.

The sorting out step includes visual inspection for detecting slices with radial cracks and warped slices. Slices with visible radial cracks or with waviness beyond the allowed value e are cut into pieces so as to obtain smaller slices of non circled shape. With reference to FIG. 4 there are shown various configurations of slices which are obtained from the cut-off raw material. These slices include crosscut circle shaped slices C, D, E having their respective diameters $D_C$, $D_D$, $D_E$, sector shaped slices A, semicircle shaped slices B and small rhomboid shaped and triangle shaped slices F, S.

It will be explained further how one can use the non-circled slices for patterning the face side of an article manufactured from the crosscut off-cut wastes.

In general in order to form the face side of a wooden tile the slices of any shape can be used. At the same time there exist some rules and restrictions dictated on the one hand by the economic effectiveness and from the other hand by the requirement to provide appropriate decorative pattern of the ready article. From this point of view it has been revealed that it is advantageous if the circled slices are divided into three groups with diameters satisfying the following relationship. The ratio between the diameters $D_C$, $D_D$ of slices C and D should be $D_D=0.44D_C$ (mm) and the ratio between the diameters $D_C$, $D_E$ of slices C and E should be $D_E=0.11D_C$ (mm). In practice diameter $D_C$ is 40–150 mm depending on the particular cutoff row material.

Now with reference to the following non limiting examples the process of manufacturing according to the present invention will be described in more details.

EXAMPLE 1

The manufacturing process refers to manufacturing of a decorative wall panel. The process comprises the following sequence of steps:

- preparation of the face side of the panel for subsequent molding thereof,
- molding of the panel,
- calibration of the panel size according to the acceptable standard,
- polishing of the face side,
- coating the face side of the panel by a lacquer.

Figure 5:
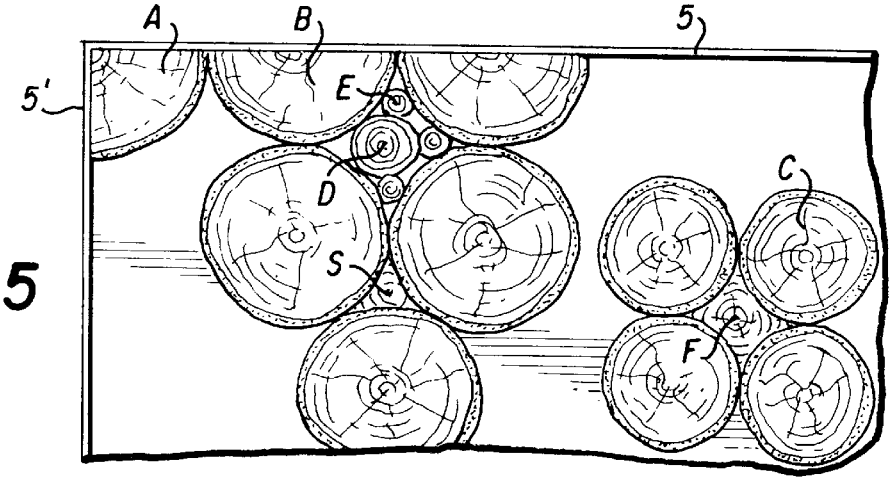
FIG. 5 shows how plurality of individual slices presented in FIG. 4 are placed on a flat support to form the tile's face side.
Figure 6:
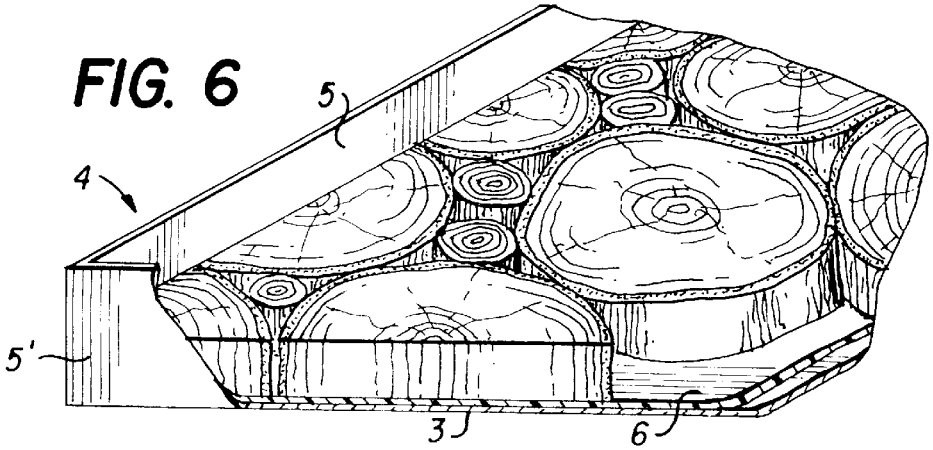
FIG. 6 shows part of a molding die filled with crosscut slices having various diameters.

With reference to FIGS. 5, 6 it is shown how crosscut slices with various configuration are placed on a flat bottom 3 of a die 4 having configuration of the ready panel. The slices are arranged as a layer to fill the content of the die defined by its bottom 3 and by side walls (only walls 5, 5' are shown). It can be seen that the empty spaces between the adjacent circled slices A, B, C are filled either by circled slices D, E of smaller diameter or by non-circled slices F, S. By virtue of this provision it is possible to fit the slices tightly within the die. Those surfaces of the slices which face the bottom of the die will form the face side of the ready panel, while the opposite surfaces which protrude from the bottom will form part of the rear side of the panel. It is advantageous the die's bottom and the side walls are coated with an anti adhesive layer 6 for example made of coarse paper. The slices are arranged within the die in the following sequence: first the circled slices A, B, C having approximately the same diameter are placed and then the free spaces between the slices and the reminder of the bottom surface is filled with the circled slices D and E having smaller diameter. It might be advantageous to use vibration for more efficient arranging the slices within the die.

After the slices are placed in the die their protruding surfaces are coated by an adhesive. This procedure should be carried out 20–60 min prior the beginning of the molding step and during this period the die with the coated slices is stored at room temperature. The purpose of this measure is to provide conditions for more homogeneous distribution of the adhesive across the slice surface and for penetration between the slices. In practice the appropriate adhesive can be suitable formaldehyde based resin, but it is most convenient to use as an adhesive the same binder component which will be used in the further molding step. The adhesive can be applied by gluing rollers or manually by a brush. The adhesive consumption per $1m^2$ of the slice surface can be 100–150 g. Care should be taken not to leave the dried slices with moisture 8–12% for a long time in the open room with moisture 60–65%.

Now the die is filled by a mixture of the binder component with the filler component. This mixture is placed over the slices so as to penetrate between them during the molding step and also to form the rear side of the panel. The appropriate binder component is a formaldehyde based resin, which can be modified by an activating additive, e.g. an carbamido-containing additive. The appropriate filler component consists of saw dust, particulate wood and pieces of thinly sliced wood (wooden chips). It is important that the moisture of the sawdust is within 2–6%. The preferred particle size of particulate wood is 5–8 mm. In practice the mixture may consist of 75–76 vol. % of the filler component and 24–26 vol % of the binder. The amount of the mixture placed on the protruding surfaces of the slices should be sufficient for molding the article having required overall dimensions and density. Since the die's interior is already occupied by the slices the required amount of the mixture will be less than it might be required for manufacturing of the article without slices. Empirically it is established that the volume of the mixture required for the manufacturing process of the present invention is by 55–60% less than in manufacturing of wooden articles without crosscut slices. It can be readily appreciated that the required amount of the binder component is reduced accordingly.

Figure 7:
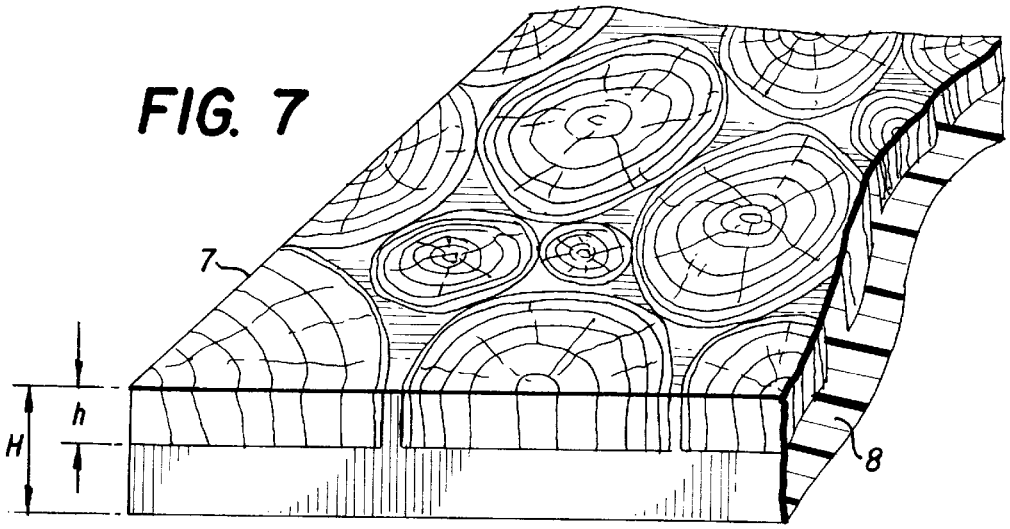
FIG. 7 is a fragment of a hot-pressed tile showing its face side and rear side.

The molding step comprises a hot pressing procedure. The fragment of the panel after it is hot pressed is shown in FIG. 7. It can be seen that the panel is configured as a flat body defined by its decorative face side 7 and by its opposite rear side 8. The major part of the face side is formed from plurality of crosscut slices and by the filler component which has penetrated between the slices. By virtue of this provision the face side features natural and contiguous structure of the crosscut wood and thus the ready tile is esthetically more attractive.

The rear side of the tile consists of the mixture of the binder with the filler. The total height of the panel is H.

The hot pressing conditions are set up empirically taking into account the change of volume of the content of the die which should bring to the required height H. It has been empirically revealed that the best results can be obtained in the time of the hot pressing procedure satisfy the following equation:

$$T=0.5\ kH\ min/mm \quad (2)$$

where

T—is hot pressing time, min

H—required thickness of the article, mm k—is empirical coefficient depending on the h/H ratio and on thermal conductivity of the wood. In practice k can vary from 0.85 to 0.96 and for example if h/H=0.45 k=0.9.

The hot pressing step is carried out at a temperature and under pressure which enable manufacturing of the ready article with required height and density. In practice the density varies between 400–1000 $kg/m^3$, the hot pressing temperature varies between 150–200° C. and the pressure varies between 1.5–2.2 MPa.

In particular the hot pressing conditions for manufacturing of plates with density 650–850 $kg/m^3$ and thickness H=18 mm are temperature 170–180° C., pressure 2.2 MPa, hot pressing time T=8.1 min. The above conditions are suitable for utilization of crosscut slices with height h=8 mm prepared from wastes of spruce, pine or other light commercial wood.

It can be readily appreciated that for effecting the above described steps one can use automatic equipment instead of time and labor consuming manual operations associated with the known in the art methods which also employ crosscut slices.

After completing the hot pressing step the articles are stored at room temperature in piles for not more than 72 hours and then are cut to required external dimensions. The face side of the ready articles is ground so as to improve the surface roughness.

In order to prevent the face side from the absorption of moisture it can be coated by a lacquer. The appropriate lacquer should have good adhesion to wood and be insensitive to temperature and moisture changes. Some examples of appropriate lacquers comprise lacquers based on saturated polyester resins, alkyd-styrol resins, etc.

EXAMPLE 2

Figure 8:
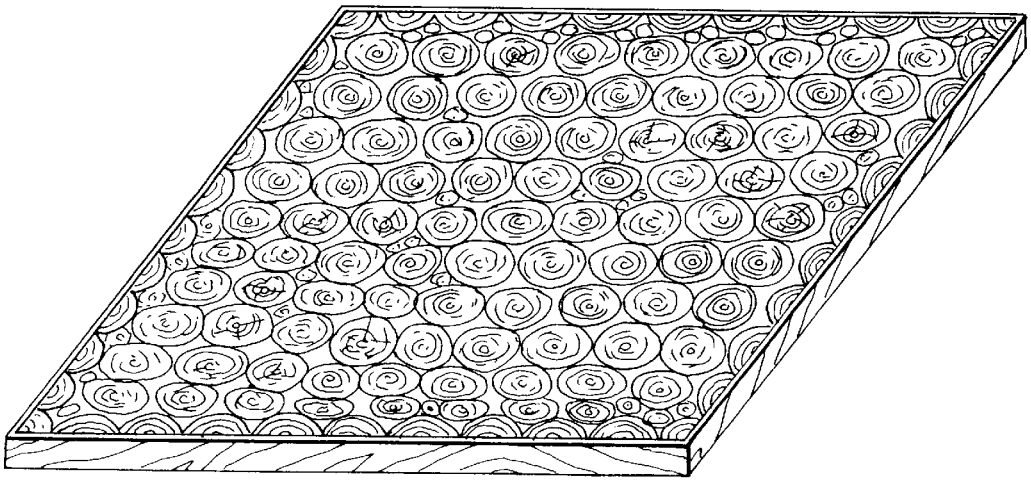
FIG. 8 shows a fragment of a ready tile with its face formed from wood slices arranged in a pattern.

In manufacture of articles for use as furniture decorative boards the article pattern is considerably dependent on the face side structure and becomes an essential feature. One of the characteristics of a furniture board is the presence of elements that impart the completeness to the appearance of the ready article. A frieze formed by special arrangement of slices along the plate lateral sides is one of such elements. The frieze is used for matching the pattern of adjacent boards and it imparts the completeness to the furniture decorated by such boards and by thus improves the decorative qualities. Despite the use of a frieze in manufacture of decorative wall panels is not an ultimate condition, nevertheless it might be desirable in manufacturing of furniture boards. With reference to FIGS. 4, 8 it will be explained now how the furniture decorative board with patterned face side can be manufactured in accordance with the present invention. The crosscut slices are prepared as described above.

The die having configuration mating the configuration of the furniture board is filled with the slices in the following sequence:

the corners are filled with semicircle shaped slices A.

the lateral sides are formed by placing the sector shaped slices B along the die walls the remainder of the interior is filled with the circled slices C having the largest diameter $D_C$ circled slices D of lesser diameter $D_D$ are fit within the gaps between the slices C and circled slices E of diameter $D_E$ are placed around the slices D if there is enough room when the wood cutoffs with round cross-section are utilized to form the face side of the board (cutoffs of veneer sheets, plywood, etc.) then the slices having rhomboid and triangular shapes F, S can be used to fill the empty space between the other slices.

The rest of manufacturing steps is similar to what is described in example 1, however in addition to the above it comprises also lamination of the rear side of the article and gluing protective coating on tis lateral sides.

It will be appreciated that the present invention is not limited to the above-described embodiments and that changes and modifications can be made by one ordinarily skilled in the art without deviation from the scope of the invention as will be defined below in the appended claims.

The features disclosed in the foregoing description, and/or in the following claims, and/or in the accompanying examples, and/or in the accompanying drawing may, both separately and in any combination thereof, be material for realizing the present invention in diverse forms thereof.

What is claimed is:

1. A method of manufacturing a wooden ready tile from a wood off-cut component, a binder component and a filler component, the tile having a tile configuration, said method comprising the following steps:

a) providing the wood off-cut component in the form of a plurality of crosscut slices, said slices being pre-cut from the wastes of wood processing industry, said slices having a substantially circular shape defined by a height h and by opposite first surfaces and parallel second surfaces, b) placing said slices within a die, said die including a flat bottom surrounded by side walls, a die configuration of the die mating the tile configuration of the ready tile, said slices being arranged on the bottom of the die so that said first surfaces face the flat bottom and define a face side of the ready tile and said opposite second surfaces protrude from the bottom, c) applying an adhesive to said slices, d) filling the die with a mixture of the binder component and the filler component, e) hot pressing the content of the die so as to achieve a required thickness H of the ready tile, f) ejecting the ready tile from the die, g) maintaining the ready tile at room temperature for not more than 72 hours, and h) grinding the face side of the ready tile and bringing overall dimensions thereof to required tolerances.

2. The method of manufacturing as defined in claim 1, in which said cross-cut slices are pre-cut from the wood wastes having substantially rectilinear shape with length 0.3–1.5 m and diameter 40–150 mm.

3. The method of manufacturing as defined in claim 2, in which said slices are pre-cut so as to have the height h not less than 0.5H, where H is the required thickness H of the ready tile and said slices have respective maximum, intermediate and minimum diameters $D_1$, $D_2$ and thereof $D_3$ defined by the following relationships $D_2=0.4\ D_1$ and $D_3=0.1\ D_1$.

4. The method of manufacturing as defined in claim 2, in which said pre-cut slices are dried before placing in the die.

5. The method of manufacturing as defined in claim 1, in which said adhesive comprises a formaldehyde based resin.

6. The method of manufacturing as defined in claim 5, in which after applying the adhesive the slices are maintained at room temperature for at least 20 minutes before filling the die with the mixture of the binder component and the filler component.

7. The method of manufacturing as defined in claim 1, in which said hot pressing step is carried out under a pressure of at least 1.5 MPa, being preferably 2.2 MPa and at temperature not less than 150° C., being preferably 170–180° C.

8. The method manufacturing as defined in claim 1, in which said ready tile is a decorative furniture board and the step of arranging said slices on the bottom of the die is carried so as to provide a pattern.

9. The method of manufacturing as defined in claim 1, in which said slices comprise semicircle shaped and sector slices.

10. The method manufacturing as defined in claim 9, in which the sector shaped slices are placed in the corners of the die, the semicircle shaped slices are placed along the walls of the die and the circle shaped occupy a remainder of the bottom surface.

11. The method of manufacturing as defined in claim 10, in which said circle shaped slices have substantially similar diameters.

* * * * *